US008491278B2

(12) United States Patent
Mello et al.

(10) Patent No.: US 8,491,278 B2
(45) Date of Patent: Jul. 23, 2013

(54) AUXILIARY BRAKING DEVICE FOR WELLHEAD HAVING PROGRESSIVE CAVITY PUMP

(75) Inventors: Paulo Mello, Sapucaia do Sul (BR); Eduardo Perdomini Lara, Porto Alegre (BR); Dalnei Tomedi, Porto Alegra (BR)

(73) Assignee: Weatherford Industria E Comecio Ltda., Rio de Janiero (BR)

( * ) Notice: Subject to any disclaimer, the term of this patent is extended or adjusted under 35 U.S.C. 154(b) by 87 days.

(21) Appl. No.: 12/873,830

(22) Filed: Sep. 1, 2010

(65) Prior Publication Data

US 2010/0322788 A1 Dec. 23, 2010

Related U.S. Application Data

(63) Continuation of application No. 11/949,374, filed on Dec. 3, 2007, now Pat. No. 7,806,665.

(30) Foreign Application Priority Data

Dec. 15, 2006 (BR) ..... 0605759

(51) Int. Cl.
*F04B 35/04* (2006.01)

(52) U.S. Cl.
USPC ..... 417/390; 417/214; 188/151 R

(58) Field of Classification Search
USPC ..... 417/214, 390; 188/151 R; 166/68
See application file for complete search history.

(56) References Cited

U.S. PATENT DOCUMENTS 3,807,902 A 4/1974 Grable et al.
4,865,162 A 9/1989 Morris et al.
5,107,967 A 4/1992 Fujita et al.
5,209,294 A 5/1993 Weber
5,251,696 A * 10/1993 Boone et al. ..... 166/250.15
5,358,036 A 10/1994 Mills
5,957,246 A 9/1999 Suzuki
5,960,886 A 10/1999 Morrow
6,079,489 A 6/2000 Hult et al.
6,113,355 A 9/2000 Hult et al.
6,125,931 A 10/2000 Hult et al.
6,152,231 A * 11/2000 Grenke ..... 166/369

(Continued)

OTHER PUBLICATIONS

Product Information Brochure; "Rod-Lock: The BOP that Clamps;" Oil Lift Technology, Inc.; Copyright 2006.

(Continued)

*Primary Examiner* — Charles Freay
*Assistant Examiner* — Patrick Hamo
(74) *Attorney, Agent, or Firm* — Wong, Cabello, Lutsch, Rutherford & Brucculeri, L.L.P.

(57) ABSTRACT

An auxiliary braking device can be used for wellhead applications having a progressive cavity pump. A housing of the device independently mounts on the pump's existing drive using a mounting member, and an adapter on the housing connects to a rotatable drive shaft of the pump. A hydraulic motor on the housing has a motor shaft mechanically coupled to the adapter by a plurality of gears or the like. A control valve couples to the hydraulic motor and operates to control communication of hydraulic fluid through the hydraulic motor, thereby controlling rotation of the rotatable shaft. A controller and electric sensors can operated the control valve in response to the sensed rotation of the shaft. Alternatively, mechanical mechanisms can operate the control valve in response to the rotation of the drive shaft.

28 Claims, 3 Drawing Sheets

U.S. PATENT DOCUMENTS

| | | | | |
|---|---|---|---|---|
| 6,419,472 | B2 * | 7/2002 | Kobensen | 418/191 |
| 6,786,309 | B2 | 9/2004 | Saruwatari et al. | |
| 6,843,313 | B2 | 1/2005 | Hult | |
| 7,044,217 | B2 | 5/2006 | Hult | |
| 2004/0182657 | A1 | 9/2004 | Kamiya et al. | |
| 2004/0261407 | A1 | 12/2004 | Du | |
| 2005/0045323 | A1 | 3/2005 | Hult | |
| 2005/0247529 | A1 | 11/2005 | Gaines et al. | |
| 2007/0158148 | A1 | 7/2007 | Ohtani et al. | |

OTHER PUBLICATIONS

Product Information Brochure; "H1800: PC Pump Drive;" Oil Lift Technology, Inc.; Copyright 2006.

Product Information Brochure; "G2000: PC Pump Drive;" Oil Lift Technology, Inc.; Copyright 2006.

Lea et al.; "What's new in artificial lift: Part 1—Fifteen new systems for beam, progressing-cavity pumping and plunger lift;" World Oil; pp. 59-71; Apr. 2005.

Product Information Brochure; "B500: PC Pump Drive;" Oil Lift Technology, Inc.; Copyright 2006.

Product Information Brochure; "B1000: PC Pump Drive;" Oil Lift Technology, Inc.; Copyright 2006.

Product Information Brochure; "B1200: PC Pump Drive;" Oil Lift Technology, Inc.; Copyright 2006.

Lea et al.; "What's new in artificial lift: Part 1—Twenty two new systems for beam, progressing cavity, hydraulic pumping and plunger lift;" World Oil; pp. 71-81; Mar. 2000.

Product Information Brochure (Internet); "Weatherford: Direct Gearbox Surface Drives;" printed from: http://www.weatherford.com/weatherford/groups/public/documents/production/pcp_directgearboxdrives.hcsp; printed Dec. 3, 2007; 2 pages.

Canadian IPO, Office Action in counterpart Canadian Appl. No. 2,613,625, dated Oct. 8, 2009.

Canadian IPO, Office Action in counterpart Canadian Appl. No. 2,613,630, dated Oct. 19, 2009.

Final Office Action in co-pending U.S. Appl. No. 11/949,360, mailed Jun. 21, 2012.

Response to Final Office Action in co-pending U.S. Appl. No. 11/949,360, filed Oct. 25, 2012.

First Office Action in co-pending U.S. Appl. No. 11/949,360, mailed May 11, 2011.

Response to First Office Action in co-pending U.S. Appl. No. 11/949,360, filed Aug. 15, 2011.

Second Office Action in co-pending U.S. Appl. No. 11/949,360, mailed Nov. 9, 2011.

Response to Second Office Action in co-pending U.S. Appl. No. 11/949,360, filed Mar. 23, 2012.

* cited by examiner

AUXILIARY BRAKING DEVICE FOR WELLHEAD HAVING PROGRESSIVE CAVITY PUMP

CROSS-REFERENCE TO RELATED APPLICATIONS

This is a continuation of U.S. application Ser. No. 11/949,374, filed 3 Dec. 2007, which is incorporated herein by reference, to which priority is claimed, and which claims priority under 35 U.S.C. §119(a) to Brazilian Patent Application No. PI 0605759-4, filed 15 Dec. 2006, to which priority is claim and which is incorporated herein by reference in its entirety. U.S. application Ser. No. 11/949,374 was filed concurrently with U.S. application Ser. No. 11/949,360 and entitled "Remote Control for Braking System of Progressive Cavity Pump" by Jorge Robles and Eduardo P. Lara, which is incorporated herein by reference in its entirety.

BACKGROUND

Progressive cavity pumps are used for artificial oil lifting operations on wellheads. FIG. 1 illustrates a typical progressive cavity pump system 10 for a wellhead 12. The progressing cavity pump system 10 has a surface drive 20, a drive shaft 30, and a downhole progressive cavity pump 40. At the surface of the well, surface drive 20 has a drive head 22 mounted above wellhead 12 and has an electric or hydraulic motor 24 coupled to drive head 22 by a pulley/belt assembly or gear box 26. Drive head 20 typically includes a stuffing box (not shown), a clamp 28, and a polished rod 29. The stuffing box is used to seal the connection between drive head 22 to drive shaft 30, and the clamp 28 and polished rod 29 are used to transmit the rotation from the drive head 22 to the drive shaft 30.

Downhole, progressive cavity pump 40 installs below the wellhead 20 at a substantial depth (e.g., about 2000 m) in the wellbore. Typically, pump 40 has a single helical-shaped rotor 42 that turns inside a double helical elastomer-lined stator 44. During operation, the stator 44 attached to production tubing string 14 remains stationary, and surface drive 20 coupled to rotor 42 by drive string 30 cause rotor 42 to turn eccentrically in stator 44. As a result, a series of sealed cavities form between stator 44 and rotor 42 and progress from the inlet end to the discharge end of pump 40, which produces a non-pulsating positive displacement flow. Because pump 40 is located at the bottom of the wellbore, which may be several thousand feet deep, pumping oil to the surface requires very high pressure. The drive shaft 30 coupled to the rotor 42 is typically a steel stem having a diameter of approximately 1" and a length sufficient for the required operations. During pumping, shaft 30 may be wound torsionally several dozen times so that shaft 30 accumulates a substantial amount of energy. In addition, the height of the petroleum column above pump 40 can produce hydraulic energy on drive shaft 30 while pump 40 is producing. This hydraulic energy increases the energy of the twisted shaft 30 because it causes pump 40 to operate as a hydraulic motor, rotating in the same direction as the twisting of drive shaft 30.

If operation of system 10 is stopped due to normal maintenance shutdown, loss of power, or overload, the accumulated energy and pressures on drive shaft 30 will cause shaft 30 to reverse spin or unwind, and this energy is transmitted to surface drive 20 as backspin. Forces generated by the backspin can then damage the surface drive 20, for example, by disintegrating pulleys or the like. To alleviate these effects, a braking system or a backspin retarder is used in surface drive 20 to control of the backspin of drive shaft 30 until the fluid head and wind-up of drive shaft 30 have been reduced to a desired level.

Typical braking systems use a ratchet or free wheel arrangement that allows for two operational modes—either free-turning or braking. For example, such ratchet or free wheel arrangements allow rotation in one direction during normal operation but actuate the braking system when rotation occurs in the opposite direction, referred to as "backspin." In this way, the braking components are only activated if there is rotation in the opposite direction.

Unfortunately, an originally installed braking system on a wellhead may no longer be capable of performing its original function for any number of reasons. For example, chemical and mechanical wear may damage hoses, connections, seals, etc. of the original wellhead braking system. In addition, surface drive 20 may overload causing wellhead to shut down, which strongly indicates that pump 40 is jammed at the bottom of the well. Such jamming may occur due to swelling of the stator's elastomer components reacting to the petroleum. In addition, intake of sand or other debris can also cause jamming. When jamming occurs and surface drive 20 lacks a torque limiter system (such as a frequency inverter programmed for this purpose), then drive 20 continues rotating shaft 30 and accumulating more energy until drive 20 breaks down due to overload. In this situation, drive 20 can apply many times the nominal torque to drive shaft 30, and the cumulative torque can even exceed the technical specifications for the braking system.

DETAILED DESCRIPTION

Figure 1:
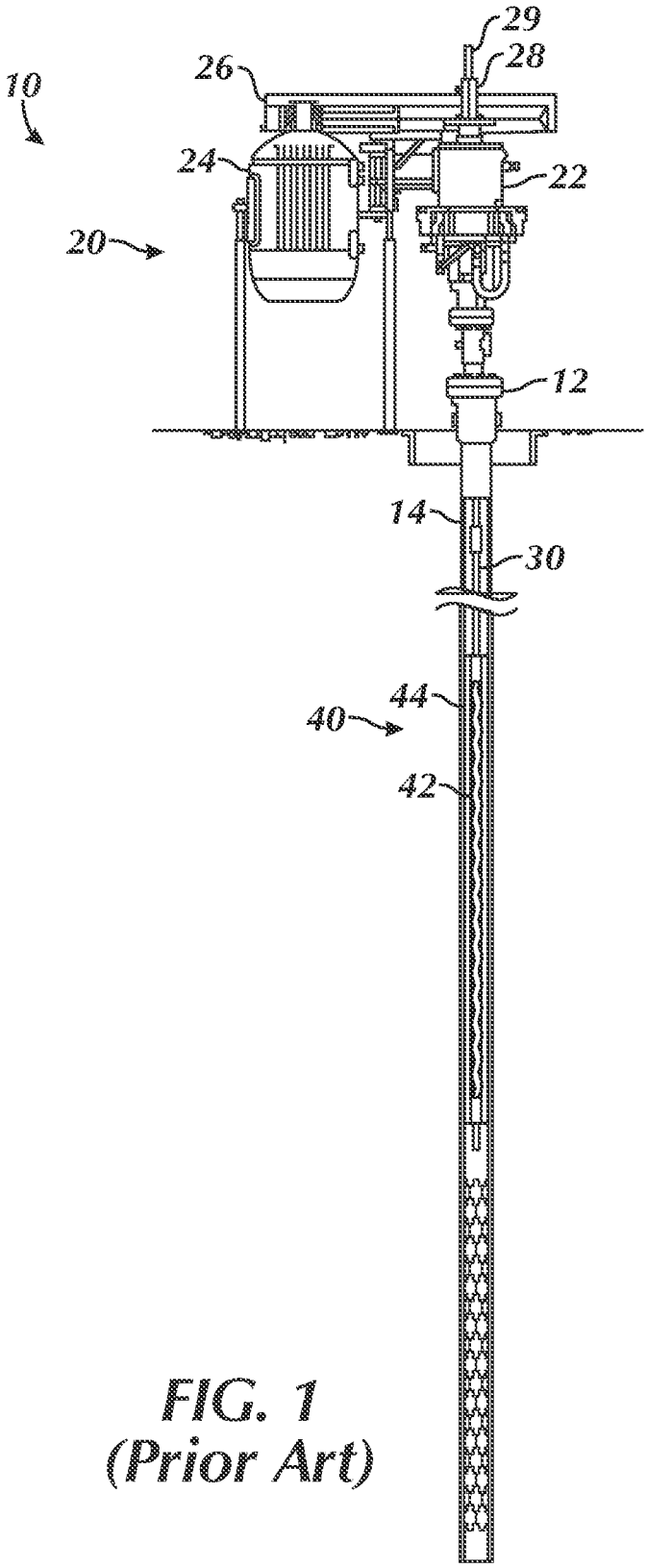
FIG. 1 (Prior Art)
FIG. 1 illustrates a progressive cavity pump system according to the prior art.
Figure 2:
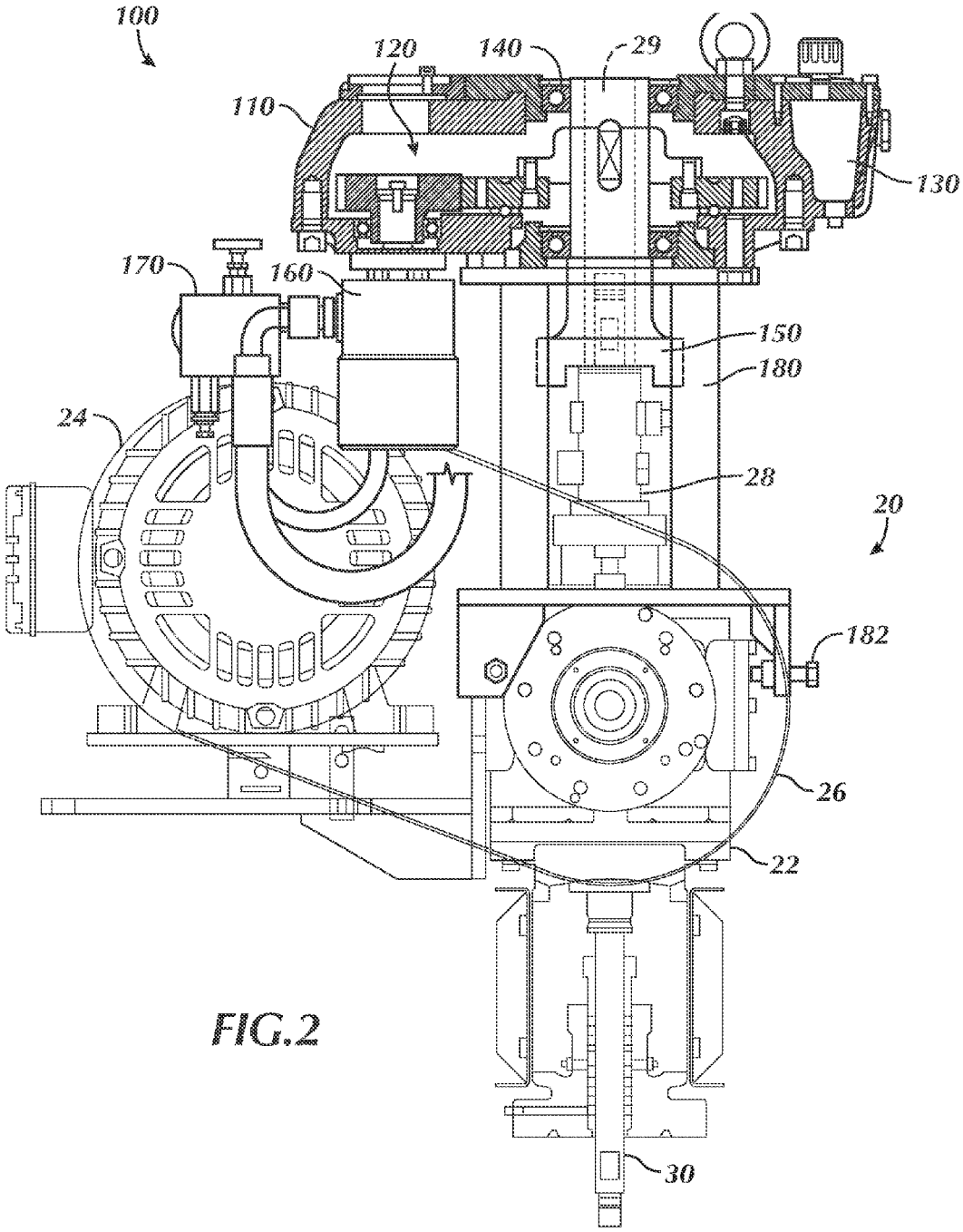
FIG. 2 illustrates a cross-sectional view of an auxiliary braking device according to one embodiment mounted on a drive head of a progressing cavity pump system.

An auxiliary braking device 100 illustrated in FIG. 2 is used to control rotation in a wellhead application having a progressive cavity pump. Auxiliary braking device 100 is mobile and can be used when greater braking capacity is needed during operations or when the existing braking capacity is not functional. Shown in cross-section, braking device 100 includes a housing 110 having a hydraulic motor 160 and a control valve 170 attached thereto. Inside, housing 110 contains a drive assembly 120 and a fluid reservoir 130. In the present embodiment, drive assembly 120 is a gear assembly having a plurality of gears, but other embodiments could use pulleys, belts, chains, or the like. Gear assembly 120 couples hydraulic motor 160 to a connection shaft or adapter 150 supported in housing by bearing assemblies 140. A fluid reservoir 130 holds hydraulic fluid for hydraulic motor 160 and is connected to motor 160 and control valve 170 by hoses.

As shown, existing surface drive 20 has drive head 22 with a clamp 28 and polished rod 29 extending above. As also shown, electric motor 24 and pulley/belt assembly 26 connect to drive 20 in a vertical orientation, such as disclosed in U.S. Pat. No. 6,125,931, which is incorporated herein by reference in its entirety. Although this vertical orientation can help provide beneficial access to clamp 28 and polished rod 29, the disclosed braking device 100 can be used with progressive cavity pumps having motors, pulley/belt assemblies, and gearboxes in other orientations.

Auxiliary braking device 100 is a mobile unit and can be used if a well is to be shut down for maintenance or if operators determine that there may be a problem. For example, if operators believe that the original braking system in drive head 22 will not operate properly (e.g., if the shutdown has occurred due to overload) or if the operator has doubts about its operational status, the operators install the auxiliary braking device 100 on the original wellhead. To install device 100, housing 110 with attached motor 160 and valve 170 removably mounts onto existing surface drive 20. For example, a vehicle having a lateral crane for work on wellheads can move device 100 to wellhead. Alternatively, braking device 100 can be presuspended above wellhead and later mounted on the wellhead when needed. Preferably, braking device 100 has a small size that allows it to be used with various implementations.

In mounting device 100 on drive head 20, a mounting base 180 and fasteners 182 or the like connect to drive head 20. Because device 100 is mobile and can preferably be used with various models of wellheads, the mounting base 180 can be configured for a particular model or type of drive. Moreover, the base 180 is preferably fastened with adjustable screws or bolts 182 to compensate for any dimensional differences in the casting of the wellhead chassis.

In mounting the device 100, connection shaft 150 also couples directly to clamp 28 on polished rod 29 using an existing insert channel on shaft 150. Through the connection, connection shaft 150 can communicate the torque generated by the drive shaft 30 to gear assembly 120 and to hydraulic motor 160. Because auxiliary braking device 100 is intended as a mobile unit to be used when needed on a drive head only for braking, the device 100 does not need to be able to freely turn in one direction. After assembly, operators can then fully or partially release the original braking system in drive head 20. Presumably, this original braking system if defective would be inoperable, causing all or part of the accumulated energy to be transmitted to auxiliary device 100, which can thereby dissipate the energy.

In operation, auxiliary braking device 100 absorbs all or part of the energy accumulated in the production well, depending on the status and/or adjustment of the original wellhead brake (not shown), which may or may not contribute to the energy dissipation process. As shaft 30 is allowed to backspin, its accumulated energy is discharged to the hydraulic motor 160. In turn, motor 160 circulates hydraulic fluid from reservoir 130, through a small circuit, through control valve 170, and back to reservoir 130. Use of hydraulic motor 160 may be preferred because a motor is better suited than a hydraulic pump to handle the potentially high amounts of transmitted torque that may occur.

Control valve 170 limits the rate at which energy is discharged (i.e., the speed at which shaft 30 can backspin) by restricting hydraulic fluid passing through the device 100. For example, the more that valve 170 is closed, the slower the fluid circulation allowed through the device 100 and the slower speed at which the shaft's backspin can be dissipated. Preferably, housing 110 has fins or other system to discharge heat to the surroundings because the restricted fluid circulation will generate heat proportional to the amount of energy being dissipated. After use, operators can then remove auxiliary device 100 from drive head 20 to perform any needed maintenance.

Auxiliary braking device 100 can be operated using either manual or automatic operation. In manual operation, an operator can activate the control valve 170 by opening or closing valve 170 according to operational requirements to increase or decrease the allowed speed of the shaft 30 when discharging the accumulated energy. Control valve 170 can even be mounted at a distance from the wellhead and allow operators to control braking device 100 remotely. For example, control valve 170 can be installed remotely using hydraulic hoses of required length and can be operated remotely by electrical connections compatible with the valve.

Figure 3A:
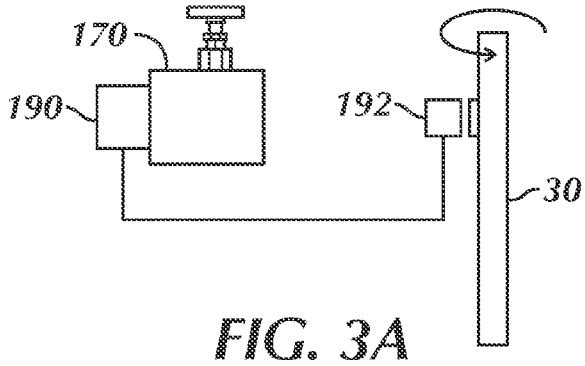
FIGS. 3A-3B schematically illustrate embodiments of automatic control systems for the disclosed auxiliary braking device.

As shown in FIG. 3A, automatic operation of auxiliary braking device 100 can use one or more speed or rotational sensors 192 mounted on or relative to drive shaft 30. Sensors 192 can be optical, electrical, and mechanical sensors known in the art and can send signals to a controller 190 directly connected to control valve 170. When an increase in speed is detected with sensors 182 above a given threshold, for example, controller 190 can close control valve 170 to restrict rotation of shaft 30 to a desired level. Moreover, controller 190 can open control valve 170 if a low speed is detected by sensors 192 below a given threshold to permit rotation of shaft 30. In this form of automatic control, selection of the rotational/speed parameters can be based on aspects of hydraulic motor 160 and other components of auxiliary braking device 100.

Figure 3B:
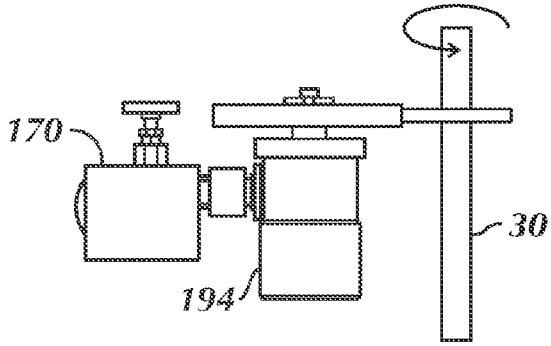
Figure 3C:
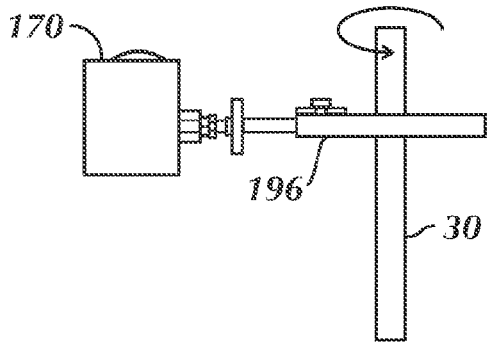

As shown in FIG. 3B, automatic operation can also be performed hydraulically using a small hydraulic pump 194 coupled to the rotation of shaft 30 by gears or the like. Using pump 194, rotation of shaft 30 can generate pressure proportional to the shaft's speed, and the generated pressure can be used to activate control valve 170 accordingly. For example, faster rotation of shaft 30 would generate higher pressures with pump 194 that would close control valve 170 more. As shown in FIG. 3C, automatic operation can also be performed using a centrifuge system 196 connected to shaft 30 to activate control valve 170 mechanically. Centrifuge system 30 can be a mechanical linkage similar to devices known in the art such as a distributor feed for a combustion motor.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A progressive cavity pump auxiliary braking device, comprising:

a body independently mountable on an existing drive of a progressive cavity pump, the body attaching directly to and detaching directly from a rotatable shaft of the existing drive without requiring disassembly of the existing drive;

a hydraulic brake positioned on the body and mechanically coupling to rotation of the rotatable shaft of the existing drive; and a control valve coupled to the hydraulic brake, the control valve operable to control communication of hydraulic fluid through the hydraulic brake and control the rotation of the rotatable shaft of the existing drive.

2. The device of claim 1, wherein the body comprises a mount being attachable to a portion of the existing drive.

3. The device of claim 1, comprising a plurality of gears mechanically coupling the hydraulic brake to the rotation of the rotatable shaft of the existing drive.

4. The device of claim 3, comprising an adapter coupled to one of the gears and positioned on the body by bearings, the adapter being coupleable to the rotatable shaft of the existing drive.

5. The device of claim 1, wherein in response to one mode of operation, the control valve controls communication of hydraulic fluid through the hydraulic brake and restricts the rotation of the rotatable shaft of the existing drive.

6. The device of claim 1, wherein in response to one mode of operation, the control valve controls communication of hydraulic fluid through the hydraulic brake and permits the rotation of the rotatable shaft of the existing drive.

7. The device of claim 1, wherein the hydraulic brake comprises a hydraulic motor or pump in fluid communication with the control valve.

8. The device of claim 1, further comprising:

an electronic sensor generating an electronic signal indicative of the rotation of the progressive cavity pump; and a controller electrically coupled to the sensor and coupled to the control valve, the controller receiving the electronic signal and operating the control valve in response thereto.

9. The device of claim 1, further comprising a hydraulic pump coupled to the control valve and to the rotation of the progressive cavity pump, the hydraulic pump responding to the rotation and operating the control valve in response thereto.

10. The device of claim 1, further comprising a mechanical linkage coupled between the rotation of the progressive cavity pump and the control valve, the mechanical linkage responding to the rotation and operating the control valve in response thereto.

11. A progressive cavity pump auxiliary braking device, comprising:

a housing independently mounting on an existing drive of a progressive cavity pump, the housing attaching directly to and detaching directly from the existing drive without requiring disassembly of the existing drive;

an adapter positioned on the housing and connecting directly to and detaching directly from a rotatable shaft of the existing drive;

a hydraulic brake positioned on the housing and mechanically coupled to the adapter; and a control valve coupled to the hydraulic brake, the control valve operable to control communication of hydraulic fluid through the hydraulic brake and control rotation of the rotatable shaft.

12. The device of claim 11, wherein the housing comprises a mount being attachable to a portion of the existing drive.

13. The device of claim 11, wherein the housing comprises a plurality of gears mechanically coupling a shaft of the hydraulic brake to the adapter.

14. The device of claim 11, wherein the housing comprises a plurality of bearings rotatably supporting the adapter.

15. The device of claim 11, wherein in response to one mode of operation, the control valve controls communication of hydraulic fluid through the hydraulic brake and restricts rotation of the rotatable shaft.

16. The device of claim 11, wherein in response to one mode of operation, the control valve controls communication of hydraulic fluid through the hydraulic brake and permits rotation of the rotatable shaft.

17. The device of claim 11, wherein the hydraulic brake comprises a hydraulic motor or pump in fluid communication with the control valve.

18. The device of claim 11, further comprising:

an electronic sensor generating an electronic signal indicative of the rotation of the progressive cavity pump; and a controller electrically coupled to the sensor and coupled to the control valve, the controller receiving the electronic signal and operating the control valve in response thereto.

19. The device of claim 11, further comprising a hydraulic pump coupled to the control valve and to rotation of the progressive cavity pump, the hydraulic pump responding to the rotation and operating the control valve in response thereto.

20. The device of claim 11, further comprising a mechanical linkage coupled between the rotation of the progressive cavity pump and the control valve, the mechanical linkage responding to the rotation and operating the control valve in response thereto.

21. A progressive cavity pump system, comprising:

a shaft of the pump system rotatably coupled to a pump;

a drive coupled to the shaft and operable to rotate the shaft in a first direction;

a brake coupled to the shaft and operable to restrict rotation of the shaft in a second direction;

a mobile braking device independently mountable to the drive and operable to restrict rotation of the shaft in at least one of the first and second directions, the mobile braking device attaching directly to and detaching directly from the shaft of the pump system without requiring disassembly of the drive.

22. The system of claim 21, wherein the mobile braking device is operable to restrict rotation of the shaft in both the first and second directions.

23. The system of claim 21, wherein the mobile braking device comprises:

a body independently mountable on the drive;

a hydraulic brake positioned on the body and mechanically coupling to the rotation of the shaft; and a control valve coupled to the hydraulic brake, the control valve operable to control communication of hydraulic fluid through the hydraulic brake and control the rotation of the shaft.

24. The system of claim 23, wherein the body comprises a mount being attachable to a portion of the drive.

25. The system of claim 23, wherein in response to one mode of operation, the control valve controls communication of hydraulic fluid through the hydraulic brake and restricts the rotation of the shaft in the second direction.

26. The system of claim 23, wherein in response to one mode of operation, the control valve controls communication of hydraulic fluid through the hydraulic brake and permits the rotation of the shaft in the first direction.

27. The device of claim 23, wherein the hydraulic brake comprises a hydraulic motor or pump in fluid communication with the control valve.

28. The system of claim 23, further comprising an automated system coupled between the shaft and the control valve and automatically operating the control valve in response to the rotation of the shaft.

* * * * *